US009947980B2

(12) United States Patent
Shih et al.

(10) Patent No.: US 9,947,980 B2
(45) Date of Patent: Apr. 17, 2018

(54) TERAHERTZ FILTER TUNING

(71) Applicant: NORTHROP GRUMMAN SYSTEMS CORPORATION, Falls Church, VA (US)

(72) Inventors: Shih-En Shih, Torrance, CA (US); Ben Gorospe, Torrance, CA (US); Kevin Leong, Los Angeles, CA (US); William R. Deal, Manhattan Beach, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 146 days.

(21) Appl. No.: 14/996,066

(22) Filed: Jan. 14, 2016

(65) Prior Publication Data

US 2017/0207507 A1 Jul. 20, 2017

(51) Int. Cl.

| | |
|---|---|
| ***H01P 1/207*** | (2006.01) |
| ***H01P 3/12*** | (2006.01) |
| ***H01P 3/00*** | (2006.01) |

(52) U.S. Cl.

CPC ..... *H01P 1/207* (2013.01); *H01P 3/00* (2013.01); *H01P 3/12* (2013.01)

(58) Field of Classification Search

CPC ..... H01P 1/2002; H01P 1/207; H01P 1/208; H01P 3/12; H01P 3/00

USPC ..... 333/208, 209, 239, 248

See application file for complete search history.

(56) References Cited

U.S. PATENT DOCUMENTS

| | | | |
|---|---|---|---|
| 6,967,347 | B2 | 11/2005 | Estes et al. |
| 7,068,129 | B2 | 6/2006 | Higgins et al. |
| 7,483,088 | B2 | 1/2009 | Chao et al. |
| 7,826,504 | B2 | 11/2010 | Chen et al. |
| 8,686,813 | B2 | 4/2014 | Deal et al. |
| 8,837,036 | B2 | 9/2014 | Mazumder |
| 8,842,948 | B2 | 9/2014 | Mazumder et al. |
| 8,913,315 | B2 | 12/2014 | Jeon et al. |

(Continued)

FOREIGN PATENT DOCUMENTS

| | | |
|---|---|---|
| CN | 203674350 U | 6/2014 |

OTHER PUBLICATIONS

Tanoto, H. et al. "Tunable Terahertz Metamaterials" Terahertz Science and Technology, ISSN 1947-7411, vol. 6, No. 1, Mar. 2013, pp. 1-25.

(Continued)

*Primary Examiner* — Robert J Pascal
*Assistant Examiner* — Rakesh Patel
(74) *Attorney, Agent, or Firm* — John A. Miller; Shumaker, Loop & Kendrick, LLP

(57) ABSTRACT

A terahertz waveguide bandpass filter block assembly including a waveguide iris filter, a pedestal block having a pedestal channel including a first one-half portion of the iris filter, and a cover block having a cover channel including a second one-half portion of the iris filter, where the first and second one-half portions combine to define the iris filter having a plurality of poles when the pedestal block and the cover block are secured together. The assembly also includes first and second ribbon strips positioned on opposing sides and adjacent to the iris filter between the pedestal block and the cover block, where a compression force between the pedestal block and the cover block compresses the first and second ribbon strips and sets an "a" dimension of the iris filter to tune the filter to a frequency band of interest.

20 Claims, 4 Drawing Sheets

(56) References Cited

U.S. PATENT DOCUMENTS

| | | | | |
|---|---|---|---|---|
| 8,946,633 | B2 | 2/2015 | Tomioka | |
| 8,958,050 | B2 | 2/2015 | Kholodnyak et al. | |
| 2003/0206082 | A1* | 11/2003 | Chen | H01P 1/208 333/208 |
| 2006/0066421 | A1* | 3/2006 | Lo Hine Tong | H01P 1/208 333/208 |
| 2012/0161905 | A1 | 6/2012 | Lee et al. | |
| 2013/0272652 | A1* | 10/2013 | Yaacobi | G02B 6/264 385/27 |
| 2014/0049342 | A1* | 2/2014 | Kozakowski | H01P 1/2016 333/208 |
| 2015/0236392 | A1* | 8/2015 | Iwanaka | H01P 1/207 333/208 |

OTHER PUBLICATIONS

Ellison, B. N. et al. "First Results for a 2.5 THz Schottky Diode Waveguide Mixer" Seventh International Symposium on Space Terahertz Technology, Charlottesville, Mar. 1996, pp. 494-502.

* cited by examiner

TERAHERTZ FILTER TUNING

GOVERNMENT CONTRACT

This invention was made with Government support under Contract HR0011-09-C-0062 awarded by DARPA. The Government has certain rights in the invention.

BACKGROUND

Field

This invention relates generally to a waveguide iris bandpass filter and, more particularly, to a waveguide iris bandpass filter block that includes compressible ribbon strips positioned on opposing sides and adjacent to an iris filter formed in the block between split halves of the block, where the strips change an "a" dimension of the iris filter so as to increase the iris openings and provide filter tuning.

Discussion

Many electronic data and communications systems employ filters for filtering both transmit and receive signals so as to only pass signals within a particular frequency band of interest. One type of bandpass filter is known as a waveguide iris bandpass filter that includes a plurality of waveguide cavity sections separated by a conductive iris configured transverse to the waveguide aperture, where the iris causes a discontinuity in the propagation of the signal by generating a shunt reactance that rejects signals outside of the frequency band of interest. The iris perturbs the electromagnetic field of the propagating wave, and its size sets the frequency band of interest and the signal return loss. A typical waveguide iris filter is defined by the number of poles that it has, where each cavity section represents a pole, and the higher the number of poles the greater the rejection of frequencies outside the frequency band of interest.

As the frequency band of interest increases the size of the waveguide of a bandpass filter decreases. As a result of machine tolerances, high frequency waveguide iris filters cannot be perfectly machined to the specific frequency band of interest. Tuning screws can be employed in waveguide iris filters to perturb the electromagnetic field of the signal so that the filter is better tuned to the desired frequency band. However, at frequency bands in the terahertz frequency range, where the waveguide dimensions are extremely small, not only do the machine tolerances have a strong impact on the filter performance, but the tuning screws become too large to provide the desired frequency tuning.

DETAILED DESCRIPTION OF THE EMBODIMENTS

The following discussion of the embodiments of the invention directed to a terahertz waveguide iris bandpass filter is merely exemplary in nature, and is in no way intended to limit the invention or its applications or uses.

Figure 1:
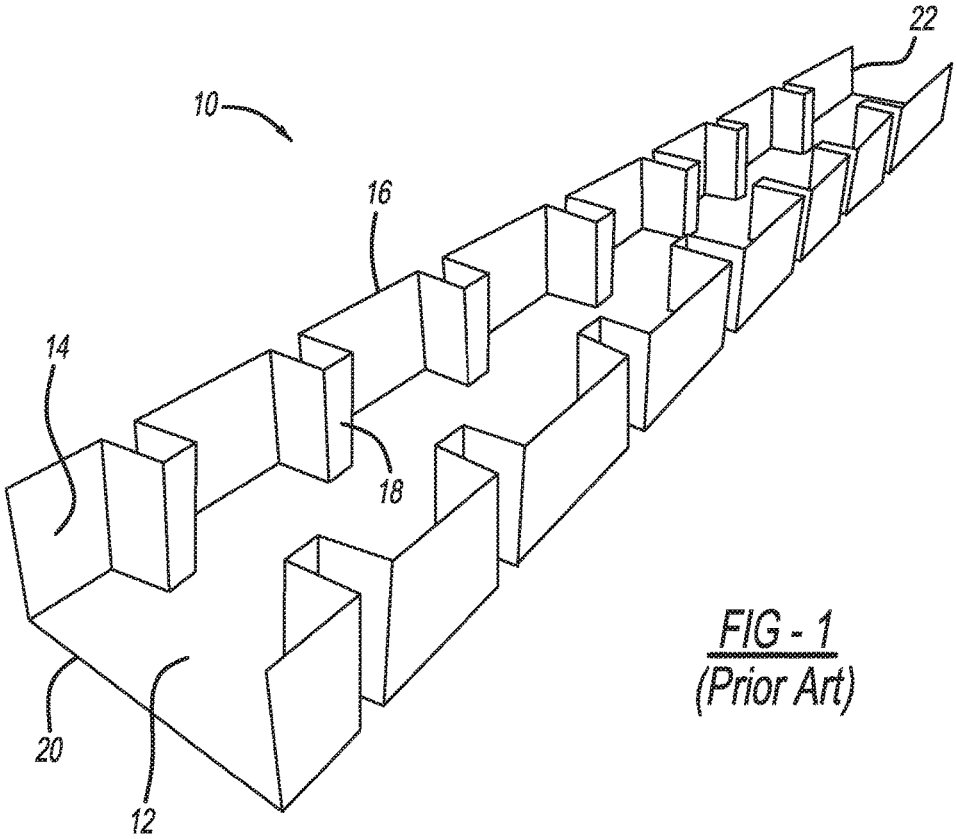
FIG - 1 (Prior Art)
FIG. 1 is broken-away isometric view of a known waveguide iris bandpass filter.
Figure 2:
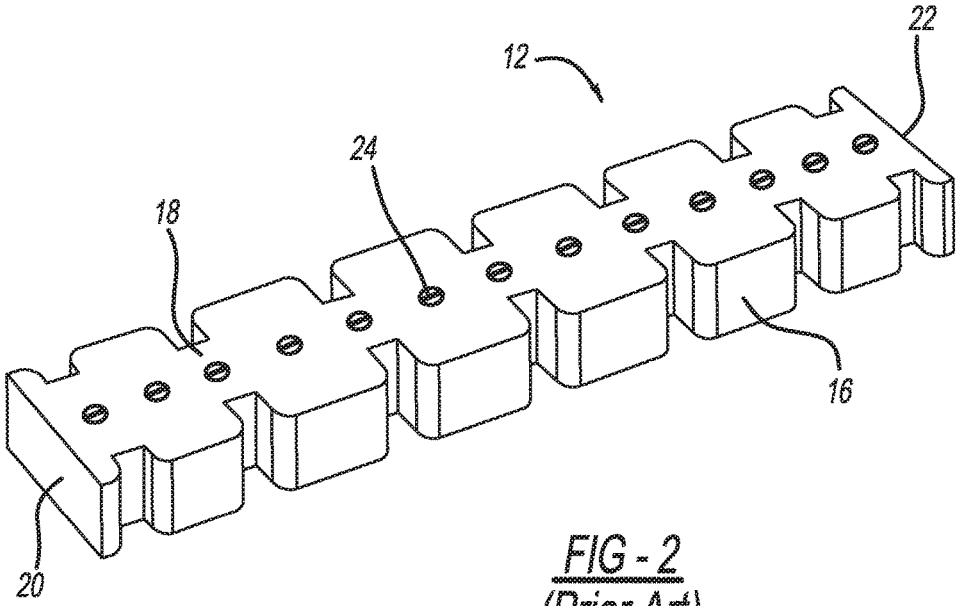
FIG - 2 (Prior Art)
FIG. 2 is an isometric view of a waveguide cavity for the filter shown in FIG. 1, and including tuning screws.

FIG. 1 is a broken-away isometric view of a traditional waveguide iris bandpass filter 10 and FIG. 2 is an isometric view of an image generally representing a waveguide cavity 12 of the filter 10. The filter 10 includes an outer wall 14 defining a number of cavity sections 16, here six, separated by narrow iris sections 18. A signal propagating down the waveguide cavity 12 from an input end 20 to an output end 22 is perturbed by the iris sections 18 so that only a frequency band of interest is able to propagate past the iris sections 18 and out the output end 22 of the filter 10 to remove frequencies outside of the frequency band of interest. Typically, the more poles, i.e., cavity sections 16, that the filter 10 has, the greater the ability of the filter 10 to reject frequencies outside of the frequency band of interest. The size of the cavity 12, the size of the cavity sections 16, the dimensions of the iris sections 18, etc. are all selected for the particular frequency band of interest. Tuning screws 24 can be provided that can be selectively extended into the cavity 12 and perturb the electromagnetic field of the signal to provide fine tuning of the filter 10. However, at very high frequencies, such as greater than 300 GHz, where the dimensions of the cavity 12 are very small, the tuning screws 24 have a limited effect on the ability to tune the signals to the frequency band of interest.

As will be discussed in detail below, the present invention proposes a technique to tune a high frequency waveguide iris bandpass filter of the type shown in FIGS. 1 and 2 by increasing an "a" dimension of the waveguide filter, which widens the opening of the iris sections 18.

Figure 3:
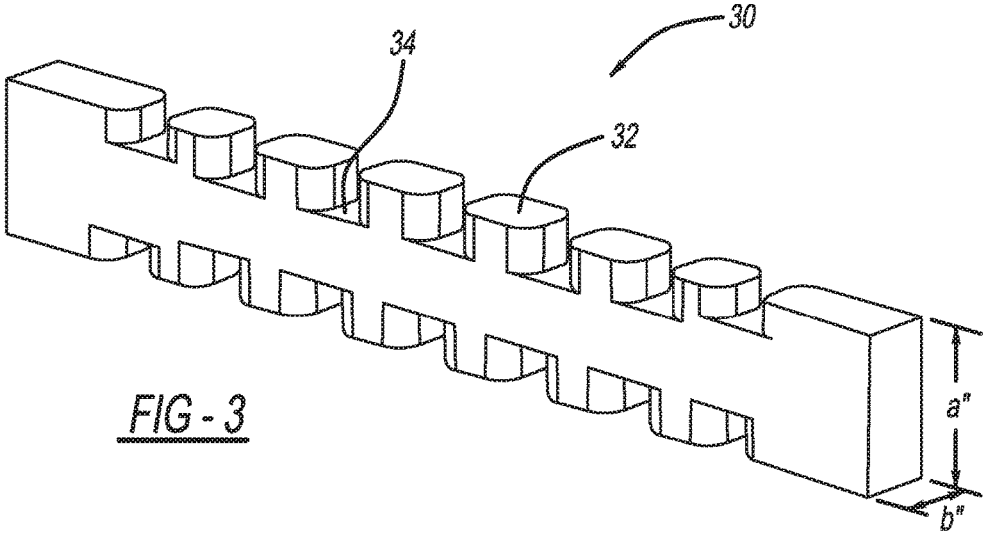
FIG. 3 is an isometric view of a six-pole waveguide iris bandpass filter.

FIG. 3 is an isometric view of a waveguide iris bandpass filter 30 similar to the filter 10, where the representation of the filter 30 shown in FIG. 3 is an illustration of the waveguide cavity of the filter 30, and where metal would be surrounding the cavity to define the waveguide opening. The filter 30 includes six waveguide cavity sections 32 separated by narrow iris sections 34 to provide the signal perturbation discussed above to reject frequencies outside of the frequency band of interest. In this non-limiting embodiment, the filter 30 is a six pole 670 GHz filter, where the distance between the cavity sections 32 or the length of the iris sections 34 is 100 μm, the length of the two end cavity sections is 184 μm, the length of the next inner two cavity sections is 221 μm, and the length of the middle two cavity sections is 227 μm. The filter 30 includes an "a" dimension that is transverse to the propagation direction of the electromagnetic signal and is in a direction across the cavity sections 32 as shown. The filter 30 also includes a "b" dimension also transverse to the propagation direction of the signal and perpendicular to the "a" dimension, where typically the "a" dimension is twice the distance of the "b" dimension. As will be discussed below, the present invention proposes to fine tune the filter 30 by selectively increasing the "a" dimension relative to the "b" dimension.

Figure 4:
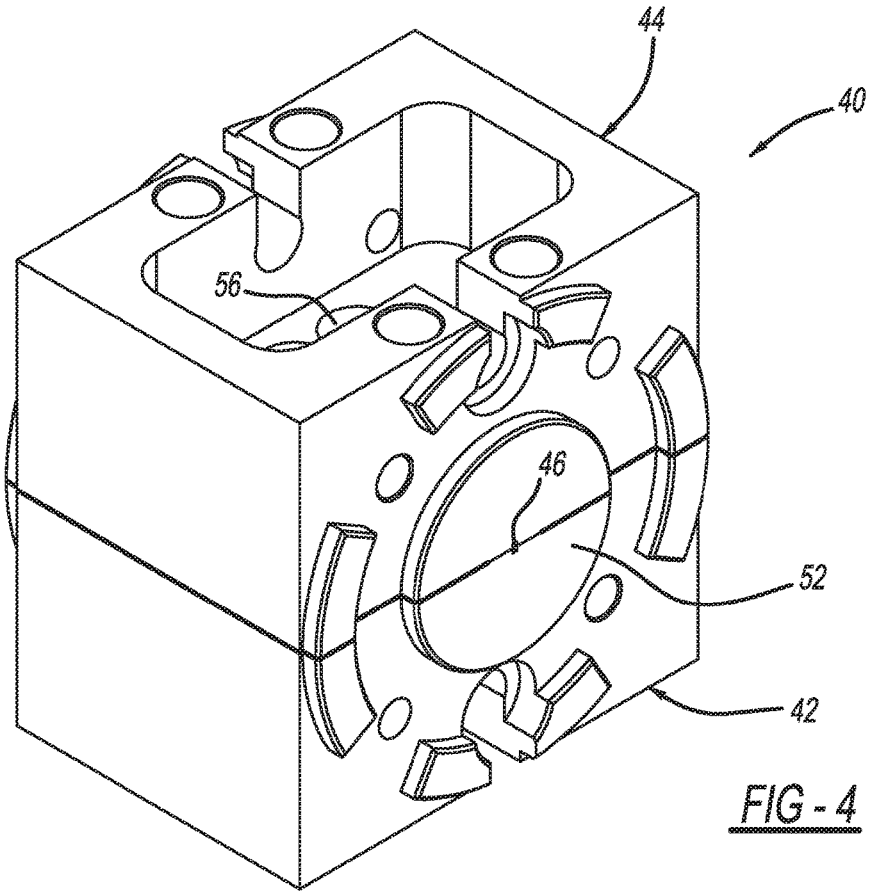
FIG. 4 is an isometric view of a split terahertz bandpass filter block including a waveguide iris filter.
Figure 5:
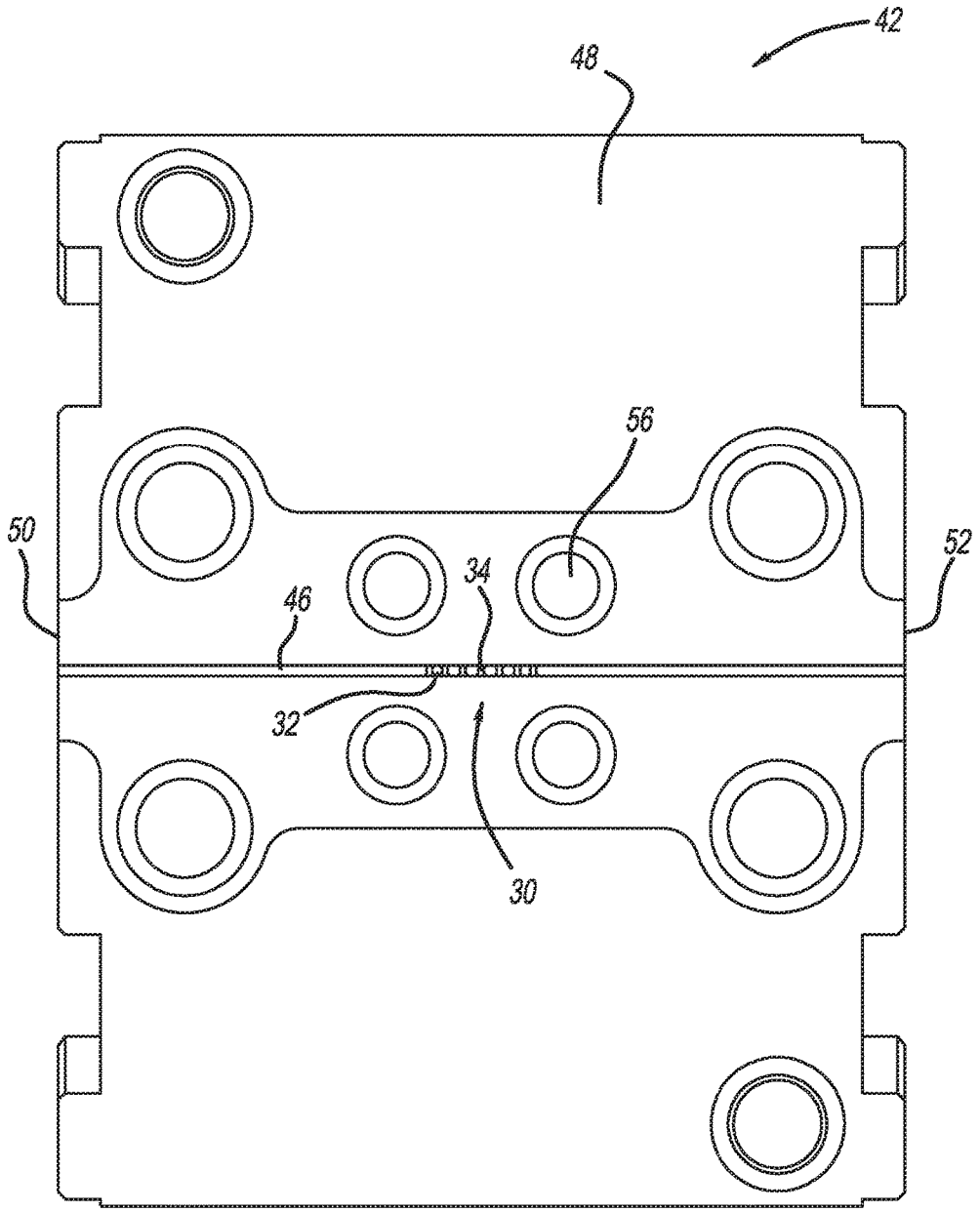
FIG. 5 is a top view of a pedestal block of the filter block shown in FIG. 4.

Waveguide filters of the type shown in FIG. 3 are often constructed as a block waveguide bandpass filter, where the filter 30 is split along a center line in the "a" dimension. FIG. 4 is an isometric view of a split waveguide bandpass filter block assembly 40 including a pedestal block 42 and a cover block 44, and FIG. 5 is a top view of the pedestal block 42 separated from the cover block 44 showing a waveguide channel 46 extending through a top surface 48 from an input end 50 of the block 42 to an output end 52 of the block 42. The blocks 42 and 44 can be made of any suitable metal, such as brass.

Figure 6:
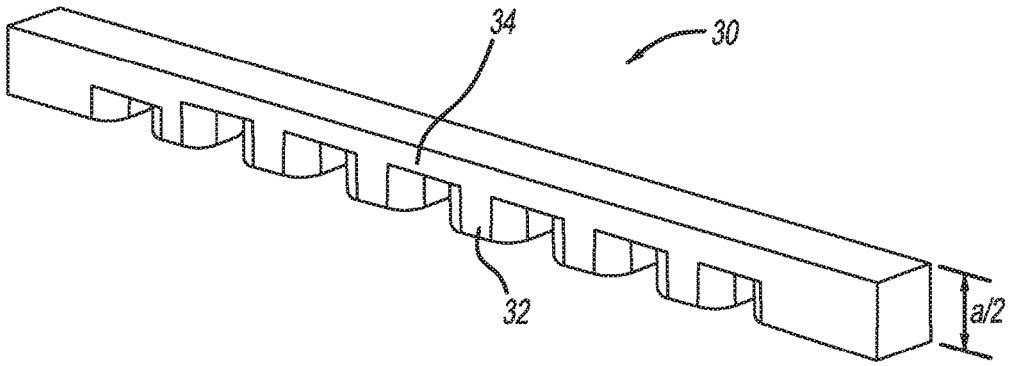
FIG. 6 is a split view of the bandpass filter shown in FIG. 3.

FIG. 6 is an isometric view of a half portion of the waveguide filter 30, which is shown disposed within the waveguide channel 46 at the center of the pedestal block 42 in FIG. 5, where the cavity sections 32 extend into the block 42. An identical waveguide filter half portion would be provided in the cover block 44 so that when the cover block 44 is secured to the pedestal block 42 the complete waveguide filter 30 is provided at the center of the complete channel 46. Typically, the blocks 42 and 44 will be secured together by bolts (not shown), such as through bolt holes 56, where the bolts provide enough torque to secure the blocks 42 and 44 together in a manner that adequately defines the channel 46 and the filter 30.

As mentioned, the present invention proposes tuning the filter 30 to a specific frequency of interest, such as 670 GHz, by selectively increasing the "a" dimension by placing a shim between the blocks 42 and 44 along the length of the filter 30 so that when the blocks 42 and 44 are compressed together, the shim increases the opening of the iris sections 34. In one non-limiting embodiment, the shims are gold ribbons or strips provided adjacent to the filter 30 on each side to increase the "a" dimension.

Figure 7:
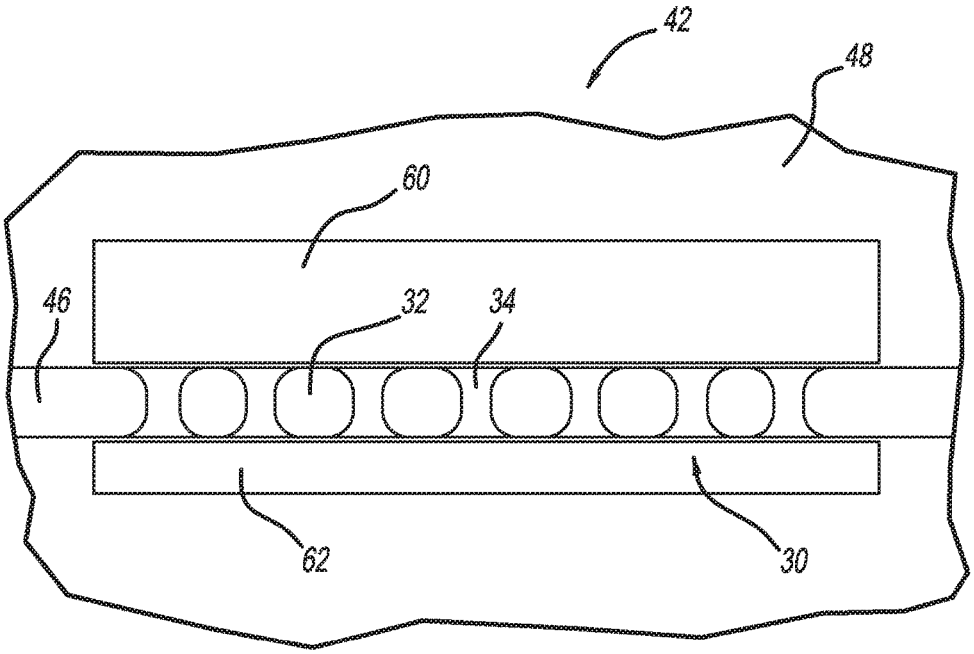
FIG. 7 is a broken-away top view of the pedestal block including gold ribbon strips positioned adjacent to the filter.

FIG. 7 is a broken-away top view of the pedestal block 42 where a gold ribbon strip 60 is positioned on one side of the filter 30 and a gold ribbon strip 62 is positioned on the opposite side of the filter 30. Gold is selected as the material for the strips 60 and 62 because it is a soft metal that is malleable under the compressive forces provided when the blocks 42 and 44 are secured together, where the strips 60 and 62 will conform to irregularities in the surface 48 of the block 42 and the opposing surface in the block 44. As will be discussed in more detail below, the width of the ribbons 60 and 62 is selectively provided so as to provide a desired compression when the blocks 42 and 44 are secured together, where different widths of the ribbon strips 60 and 62 will compress differently under the same compression force and provide different "a" dimensions. More particularly, when the blocks 42 and 44 are secured together, which compresses the strips 60 and 62, the larger surface area of a wider strip causes less compression of the strip, and thus, a larger increase in the "a" dimension. Additionally, the amount of the torque placed on the bolts that secure the blocks 42 and 44 together also determines how much the ribbon strips 60 and 62 will be compressed.

In this non-limiting embodiment, the ribbon strips 60 and 62 have a thickness of 0.5 mils, where other thicknesses may be applicable. For terahertz filter tuning, it is desirable to adjust the "a" dimension between 0 and 0.5 mils in order to shift the frequency of the signal to provide the tuning. To provide this level of tuning it is proposed to have available ribbon strips of 3, 5, 10 and 20 mils. In FIG. 7, the ribbon strip 60 is 20 mils wide and the ribbon strip 62 is 5 mils wide, which is by illustration only in that for a working filter, the ribbon strips 60 and 62 would have the same width.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A waveguide bandpass filter block assembly comprising:

a pedestal block including a pedestal channel extending into and across a top surface of the pedestal block, said pedestal channel including a first one-half portion of an iris filter;

a cover block including a cover channel extending into and across a bottom surface of the cover block, said cover channel including a second one-half portion of the iris filter, wherein the first and second one-half portions combine to define the iris filter having a plurality of poles when the pedestal block and the cover block are secured together; and first and second ribbon strips positioned on opposing sides and adjacent to the iris filter between the pedestal block and the cover block, wherein a compression force between the pedestal block and the cover block compresses the first and second ribbon strips and sets an "a" dimension of the iris filter to tune the filter to a frequency band of interest.

2. The assembly according to claim 1 wherein the first and second ribbon strips are gold ribbon strips.

3. The assembly according to claim 2 wherein the first and second ribbon strips have a thickness of about 0.5 mils.

4. The assembly according to claim 1 wherein the first and second ribbon strips have a width to selectively increase the "a" dimension of the filter between 0 and 0.5 mils.

5. The assembly according to claim 4 wherein the width of the first and second ribbon strips is selected from the group consisting of 3, 5, 10 and 20 mils.

6. The assembly according to claim 1 wherein the first and second strips have the same width.

7. The assembly according to claim 1 wherein the pedestal block and the cover block are secured together by bolts, and wherein a torque pressure on the bolts sets the compression force between the first and second ribbon strips.

8. The assembly according to claim 1 wherein the plurality of poles is defined by wide waveguide sections separated by narrow iris sections.

9. The assembly according to claim 1 wherein the iris filter includes six poles.

10. The assembly according to claim 1 wherein the iris filter is tuned to 670 GHz.

11. A terahertz waveguide bandpass filter block assembly including a waveguide iris filter, said assembly comprising:

a pedestal block including a pedestal channel extending into and across a top surface of the pedestal block, said pedestal channel including a first one-half portion of the iris filter;

a cover block including a cover channel extending into and across a bottom surface of the cover block, said cover channel including a second one-half portion of the iris filter, wherein the first and second one-half portions combine to define the iris filter having six poles when the pedestal block and the cover block are secured together by bolts, wherein the plurality of poles is defined by wide waveguide sections separated by narrow iris sections; and first and second gold ribbon strips positioned on opposing sides and adjacent to the iris filter between the pedestal block and the cover block, wherein a compression force between the pedestal block and the cover block compresses the first and second ribbon strips and sets an "a" dimension of the iris filter to tune the filter to a frequency band of interest, wherein a torque pressure on the bolts sets the compression force between the first and second ribbon strips.

12. The assembly according to claim 11 wherein the first and second ribbon strips have a thickness of about 0.5 mils.

13. The assembly according to claim 11 wherein the first and second ribbon strips have a width to selectively increase the "a" dimension of the filter between 0 and 0.5 mils.

14. The assembly according to claim 13 wherein the width of the first and second ribbon strips is selected from the group consisting of 3, 5, 10 and 20 mils.

15. The assembly according to claim 11 wherein the first and second strips have the same width.

16. The assembly according to claim 11 wherein the iris filter is tuned to 670 GHz.

17. A waveguide bandpass filter block assembly comprising a pedestal block including a first one-half portion of an iris filter, a cover block including a second one-half portion of the iris filter, and first and second ribbon strips positioned on opposing sides and adjacent to the iris filter between the pedestal block and the cover block, wherein a compression force between the pedestal block and the cover block compresses the first and second ribbon strips and sets an "a" dimension of the iris filter to tune the filter to a frequency band of interest.

18. The assembly according to claim 17 wherein the first and second ribbon strips are gold ribbon strips.

19. The assembly according to claim 17 wherein the first and second ribbon strips have a thickness of about 0.5 mils.

20. The assembly according to claim 17 wherein the first and second ribbon strips have a width to selectively increase the "a" dimension of the filter between 0 and 0.5 mils.

* * * * *